United States Patent [19]

Owen et al.

[11] 4,310,782

[45] Jan. 12, 1982

[54] LAMP FILAMENT SUPPORT

[75] Inventors: Peter Owen; John M. Rees, both of Merthyr Tydfil, Wales

[73] Assignee: Thorn EMI Limited, London, England

[21] Appl. No.: 119,874

[22] Filed: Feb. 8, 1980

[30] Foreign Application Priority Data

Feb. 9, 1979 [GB] United Kingdom ..... 04625/79

[51] Int. Cl.[3] ..... H01J 1/88; H01J 19/42; H01K 1/18

[52] U.S. Cl. ..... 313/271; 313/274; 313/279

[58] Field of Search ..... 313/171, 172, 173, 174, 313/175, 179, 271, 272, 273, 274, 275, 279

[56] References Cited

U.S. PATENT DOCUMENTS

| | | | |
|---|---|---|---|
| 3,225,247 | 12/1965 | Audesse et al. | 313/279 X |
| 3,243,633 | 3/1966 | Ackerman | 313/274 X |
| 3,286,116 | 11/1966 | Malm | 313/274 |
| 3,530,329 | 9/1970 | Stone et al. | 313/279 X |
| 3,760,217 | 9/1973 | Martin et al. | 313/279 |

*Primary Examiner*—Saxfield Chatmon, Jr.
*Attorney, Agent, or Firm*—Robert F. O'Connell

[57] ABSTRACT

An improved filament support of especial value in linear tungsten halogen lamp of low wattage, is formed from a composite wire which comprises a core wire overwound with a further wire, both of tungsten. The supports according to the invention afford better grip and reduced weight as compared with the supports of the prior art.

10 Claims, 3 Drawing Figures

LAMP FILAMENT SUPPORT

The present invention relates to incandescent filament lamps, and more especially to tungsten halogen lamps with linear filaments.

One of the major difficulties in the manufacture of linear tungsten halogen lamps is the provision of an adequate support for the filament, which will prevent the filament coil from sagging and touching the bulb, especially after long bulb lives of the order of 2000 hours or more. Supports in the form of spirals of tungsten wire have been used for some twenty years, and are adequate for single coil filaments of rating 240 v 750 w and upwards.

With ligher coils of lower rating, problems persist. The coil, owing to its flimsy nature, does not grip the support and tends to become detached during transit or operation. A further difficulty with light-weight filament coils is that the support is too heavy and rigid for the coil and can lead to filament breakage in transit. These difficulties are particularly apparent with coiled coil filaments and ratings below 300 w.

The present invention is concerned to reduce these difficulties, and is characterized by the use of supports formed from a core of tungsten wire overwound with a coil of further tungsten wire.

The composite support wires according to this invention may have an overall diameter comparable with that of the simple wires previously employed, but have the advantage of a considerably reduced weight, which can be as little as 40% of that of a simple wire of the same overall diameter. Although the composite wire has a lower strength than a single wire of similar overall diameter, it still has ample strength for the purposes of a filament support. A further advantage is that the overwound coil provides a degree of grip and meshes with the primary winding of a coiled coil filament.

The overwind wire will usually have a diameter less than that of the core wire, for example about half its diameter, and is preferably wound with substantial spacing between adjacent turns. This spacing may be of the same order as the diameter of the overwind wire.

The invention will be further described, by way of example, with reference to the accompanying drawings, in which.

Figure 1:
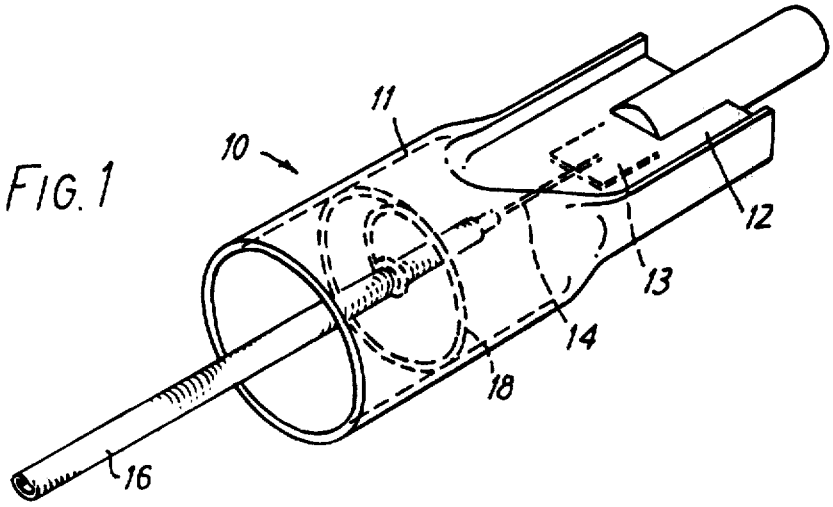
FIG. 1 is a diagrammatic view of one end of linear halogen lamp.

The lamp 10 shown in FIG. 1 comprises a tubular envelope 11 of fused silica, containing a conventional fill of inert gas and halogen, the ends of the tube being sealed by press seals 12. The press seals enclose molybdenum foils 13 to which are connected conductive end supports 14 carrying a coiled coil tungsten filament 16, which is supported at points along its length by spiral supports 18.

Figure 2:
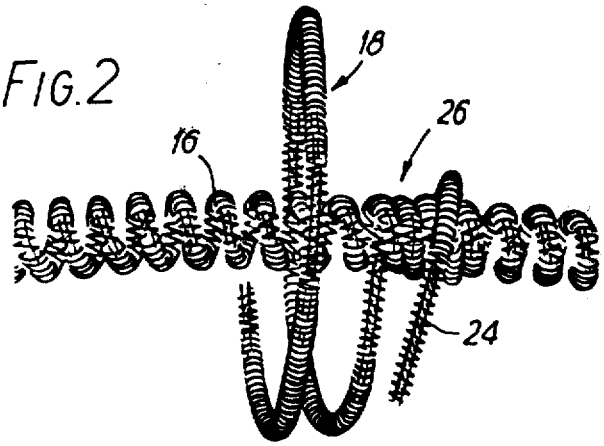
FIG. 2 is a perspective view of a portion of a coiled coil filament engaged with a support according to this invention.
Figure 3:
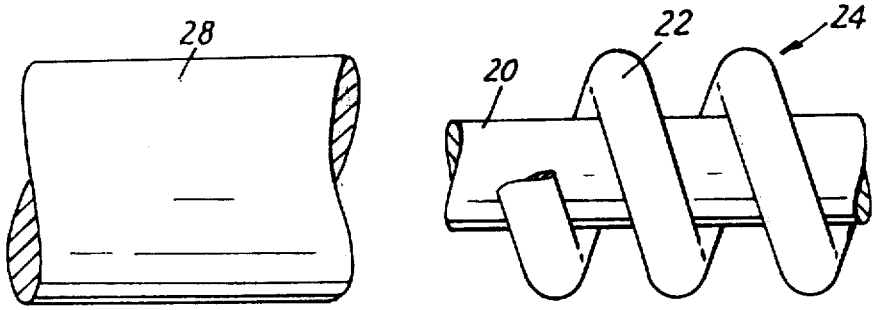
FIG. 3 is a fragmentary view, on a larger scale, of the composite support wire of this invention compared with a simple support wire of the prior art.

In accordance with this invention, the supports 18 are formed from a tungsten core 20 overwound with a further tungsten wire 22, which will usually be of smaller diameter, as shown in FIGS. 2 and 3. In the former figure, the support wire 24 is itself formed into a coil at 26, which engages with the coil of the coiled coil filament 16, thereby holding it more securely against detachment by shock.

In FIG. 3 are compared a simple wire 28 of the prior art and a composite support wire 24 of this invention, having a similar overall diameter. The composite wire 24 can be produced by coiling the overwind wire 22 round the core wire 20 by a conventional coiling process, and is then heat treated. The supports 18 can then be fabricated and applied using the usual techniques.

The following is one example of the practice of this invention.

In a linear tungsten halogen lamp of 240 v 200 w rating having a coiled coil filament, supports of 5.0–5.5 mm diameter were fitted. Each support employed 28.7 mm composite wire, formed of 28.7 mm core wire of 0.1016 mm diameter and 59.98 mm overwind wire of 0.0635 mm diameter, the overall diameter of the composite wire being 0.2256 mm.

The total weight of each support was 8.18 mg, whereas the weight of a comparable support formed from 28.7 mm of a simple wire of the same overall diameter was 22.80 mg. The saving in weight in this instance is about 60%

Although the invention is of particular value in the provision of supports for linear filament coils in tungsten halogen lamps of low rating, where the coil is very flimsy, it will be appreciated that the same principles may be applied in other situations where a filament support of improved grip or reduced weight is desirable.

We claim:

1. In a support for a linear incandescent lamp filament, the support comprising a loop or spiral structure adapted to fit within and against the inner wall of a lamp envelope and to support the filament along its length spaced from said inner wall, the improvement comprising forming said support from a core length of tungsten wire and a coil of further tungsten wire overwound on said core.

2. A support according to claim 1, in which the overwound wire is formed at one end thereof into a coil which meshes with a coil of the lamp filament.

3. A support according to claim 1 in which the diameter of the overwind wire is less than that of the core wire.

4. A support according to claim 1 in which the diameter of the core wire is about 0.1 mm and that of the overwind wire about 0.06 mm.

5. A support according to claim 1, in which the length of overwind wire employed is about twice that of the core wire per unit length of support.

6. In an incandescent lamp comprising an envelope, a linear filament in said envelope, electrical leads for said filament sealed in said envelope, and at least one filament support formed as a loop or spiral structure to fit against the inner wall of said envelope and to locate said filament within said envelope at a respective point along its length, the improvement comprising a filament support formed from a core length of tungsten wire and a coil of further tungsten wire overwound on said core.

7. A lamp according to claim 6 in the form of a linear tungsten halogen lamp.

8. A lamp according to claim 7, in which the filament is a coiled coil and said support is formed at one end thereof into a coil which meshes with a coil of the lamp filament.

9. An incandescent lamp including: a tubular envelope; a linear filament in said envelope; electrical leads for said filament sealed in said envelope and at least one substantially spiral support having at least one outer turn fitting against the inside wall of said envelope to take a substantially rigid position in relation thereto and at least one inner turn supporting the filament at a respective position along its length, wherein the support is formed from a core of tungsten wire and a coil of further tungsten wire overwound on said core.

10. A linear tungsten halogen lamp including: a tubular envelope; a linear filament in said envelope; means for supporting the ends of the filament and for providing electrical connection thereto from outside the envelope and at least one further support adapted to support the filament spaced from the envelope at a respective position between the ends thereof wherein the further support comprises a substantially spirally formed core length of tungsten wire and a coil of further tungsten wire overwound on said core, said support being shaped to press against the inside of the envelope and one end thereof being formed into a coil which meshes with a coil of the lamp filament.

* * * * *